United States Patent [19]

Schmanski et al.

[11] Patent Number: 4,958,954

[45] Date of Patent: Sep. 25, 1990

[54] HORIZONTAL REFLECTIVE HIGHWAY MARKER

[75] Inventors: Donald W. Schmanski; Michael M. Leigh, both of Carson City, Nev.

[73] Assignee: Carsonite International, Carson City, Nev.

[21] Appl. No.: 279,675

[22] Filed: Dec. 5, 1988

[51] Int. Cl.[5] ..... E01F 9/00

[52] U.S. Cl. ..... 404/10; 256/1

[58] Field of Search ..... 404/9, 10; 403/2; 256/1, 13.1; 40/608; 248/160, 222.1

[56] References Cited

U.S. PATENT DOCUMENTS

| | | | |
|---|---|---|---|
| 4,245,922 | 1/1981 | Auriemma | 404/10 |
| 4,269,534 | 5/1981 | Ryan | 404/10 |
| 4,596,489 | 6/1986 | Mariol et al. | 404/10 |
| 4,636,108 | 1/1987 | Duckett | 404/10 |
| 4,645,168 | 2/1987 | Beard | 404/10 X |

*Primary Examiner*—William P. Neuder

*Attorney, Agent, or Firm*—Thorpe, North & Western

[57] ABSTRACT

A delineator device having high visibility and utility for attachment to a paving surface such as a median curb or other dividing area between two lanes of traffic. The device includes an integral base member and vertical support member having a top and a bottom end and intermediate section including an elongated concave-convex structure. The bottom end of the vertical support is coupled to an upper face of the base to provide support for an attached horizontal member at the top end of vertical support member. This horizontal member includes top and bottom edges and an intermediate section which is also of concave-convex structure. A receiving base is provided for insertion of a projection tab section which extends downward from the base member. Locking flanges are attached to the tab to enable the device to be secured in its inserted position.

5 Claims, 2 Drawing Sheets

HORIZONTAL REFLECTIVE HIGHWAY MARKER

BACKGROUND OF THE INVENTION

1. Field of Invention

The present invention relates to road markers which provide high target exposure. More particularly, the present invention relates to high target road markers having horizontal orientation of reflective surfaces.

2. Prior Art

Delineation of median islands and other low level road obstructions requires reflective markers which are quickly observable from many orientations. This is particularly true during night driving conditions because the road surface and median curb merge in shadows which are difficult to distinguish.

Many forms of reflector materials and markers have been applied to this difficult delineation area. These include vertical reflectors which provide 360 degree reflection and which may be attached directly to the median island surface. Ideally, such delineators are removable to enable replacement subsequent to damage or wear.

In addition to the tubular delineators previously mentioned horizontal delineation has been applied which supplies a lateral array of reflective material and specifically oriented towards the primary direction of traffic flow. Such horizontal markers are designed to comply with the higher target area of reflective surface specified in MUTCD standards. Obviously, the intent is to quickly catch the attention of a drive, whose headlights pass across the horizontal line of reflective material.

Unfortunately, a disadvantage of the horizontal delineator is the large target area subject to impact by car wheels and vehicles. Instead of a four or five inch wide upright marker, the target area may consist of a horizontal marker extending as much as 12 to 16 inches in width. Such extension increases the likelihood of tire collision by three or four times.

It is essential, therefore, that such delineators develop flexibility which preserves the life of the marker during wheel and vehicle collisions. In addition to flexibility, the marker upright must be resilient to return the marker to its proper orientation after being run over by a vehicle or car wheels. Meeting such criteria with long range survivability is a difficult proposition. Survival rates of current state of the art delineators of this type may run in the matter of only weeks, in high impact zones.

Therefore, what is needed is a highly visible, horizontal delineation device which is adapted to survive frequent impact and at the same time provide for simple installation and replacement.

OBJECTS AND SUMMARY OF THE INVENTION

It is therefor an object of the present invention to provide a horizontal delineation device which is specifically adapted to survive repeated impacts by wheeled vehicles.

It is a further object of this invention to provide a horizontal delineator device which gives maximum reflection from oncoming vehicle headlights.

It is a still further object of this invention to provide a modular construction wherein the delineator device can be quickly installed and replaced to a fixed base adhered to a road surface.

Yet another object of this invention is to provide a locking device for retaining the removable horizontal delineator in position and to reduce occurrences of vandalism and theft.

These and other objects are realized in a delineation device having high visibility along a horizontal, raised orientation and comprising a base member formed as a plate with upper and lower faces and a vertical support member having a top end and a bottom end and intermediate sections including an elongated concavo-convex structure which is configured to face oncoming traffic when mounted at the path paving surface. A horizontal member is centrally coupled near the top end of the vertical support member and includes opposing distal sides, a top edge and a bottom edge, the combination of sides and edges enclosing a concavo-convex intermediate section adapted to face oncoming traffic when mounted at the paving surface. The lower face of the base member includes means for adhering the structure to a paving surface. A specific base providing modular construction to facilitate installation and quick removal includes a top base, a substantially flat bottom face and an intermediate support body with sufficient length to vertically support the length of a tab section which extends downward from the bottom face of the base member. This support body includes a slot capable of receiving the tab section and is also provided with means for locking the tab section in place to prevent vandalism.

Other objects and features of the present invention will be apparent to those skilled in the art based upon the following detailed description, taken in combination with the accompanying drawings.

DETAILED DESCRIPTION OF THE INVENTION

Figure 1:
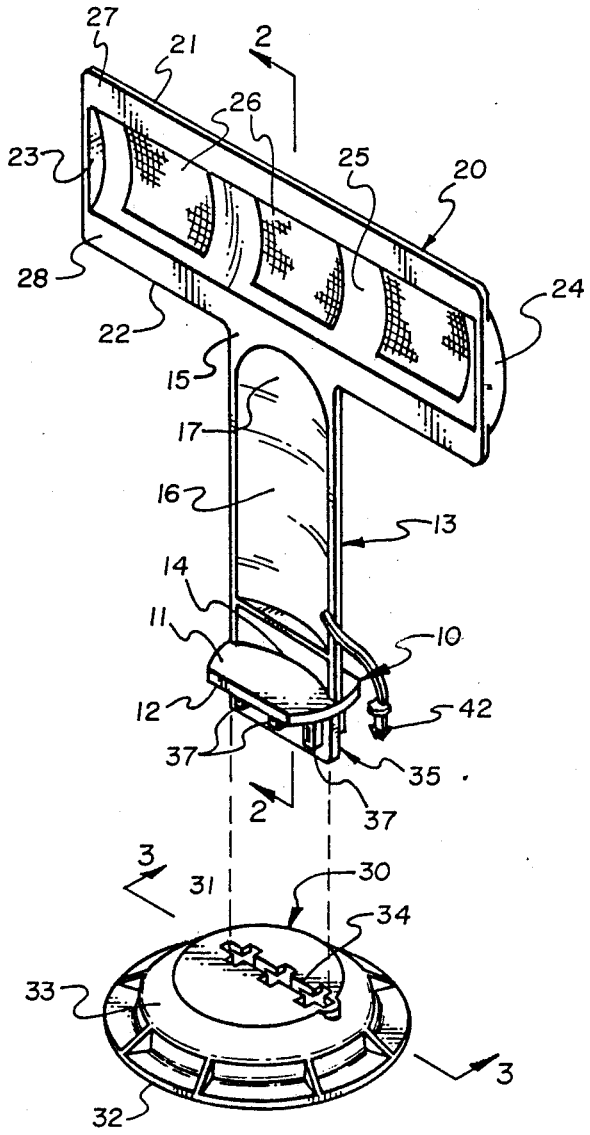
FIG. 1 shows a separated view of the present invention embodying a permanently fixed base section with a removable delineator section.
Figure 2:
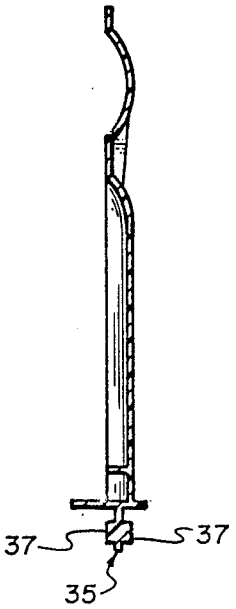
FIG. 2 shows a cross section of the delineator member taken along the lines 2—2.

Referring now to the drawings:

One embodiment of the present invention is shown in FIG. 1 and includes a base member 10 which has an upper face 11 and lower face 12. The plate construction can be formed in a variety of geometric configurations which are structurally adapted to provide support to an upright vertical support member 13 which is centrally coupled 14 to the base plate 10.

The vertical support member includes a top edge 15 and a bottom edge (also identified as item 14 at the point of attachment to the plate). An intermediate section 16 comprises an elongated, concavo-convex structure which is adapted to face toward oncoming traffic when mounted at the paving in proximate figuration. This concavo-convex structure is provided to give added support strength and stiffness to the vertical support member 13 to properly bear the weight of a horizontal member 20 which is attached at the top of the vertical support member. The horizontal member includes a top edge 21, a bottom edge 22, opposing distal sides 23 and 24, and an interior section intermediate between the top and bottom edges and between the opposing distal sides which comprises a second concavo-convex structure 25 similarly configured to face toward oncoming traffic when in its proper mounted position.

Reflective sheeting 26 is affixed within the concave structure of the horizontal member and is thereby protected from abrasive contacts arising from vehicle impacts, as well as from full exposure to sun and weather.

The concavo-convex structure of the vertical support member and the horizontal member provide added survivability to impacts because of the capability of the structure to deform and flatten and thereby become more flexible. The vertical support member utilizes such concavo-convex structure to extend across the full width to maximize stiffness for supporting the horizontal member. In contrast, the concavo-convex structure of the horizontal member extends only partially along the distance between the top and bottom edges. Instead, the horizontal member includes planar faced sections 27 and 28 which bridge the distance between the top edge 21 and the concavo-convex structure, as well as its distance from the bottom edge 22.

The stiffness of the vertical support member is further enhanced by extending the length of the concavo-convex section all the way from the juncture of the bottom edge 14 at the upper face 11 of the base plate, extending to the bottom edge 22 of the horizontal member. The upper ends 17 of the concavo-convex structure closes with the planar face 28 and attached top ridge 15 in a rounded configuration to increase the amount of stiffness at this section. This results in collapse or bending of the structure in the intermediate section 16. Such bends are characterized by large folds, as opposed to localized stress, thereby extending the life of the marker. The stiffness in region 17 prevents folds and bending at this juncture between the vertical and horizontal members. This avoids cracking and other forms of failure at this weaker location.

The delineator device may also be attached to a pavement surface by means of a fixed receiving base 30. This base includes a top face 31 and a substantially flat bottom face 32, with an intermediate support body 33 positioned therebetween. The intermediate support body 33 has a slotted housing 34 configured to receive a projecting tab section 35 which is attached to the bottom face 12 of the base plate 10. The cross section of the tab section 35 conforms to the opening cross section of the slotted housing 34 to permit insertion of the tab section therein. The vertical length of the intermediate support body 33 is sufficiently long to provide the required lateral support with respect to the inserted tab section which mate in a snug fit.

Means are provided on the tab section for locking this portion of the delineator within the slotted portion 34 of the intermediate support body 33. Several embodiments of such a locking device are illustrated in the figures.

Figure 3:
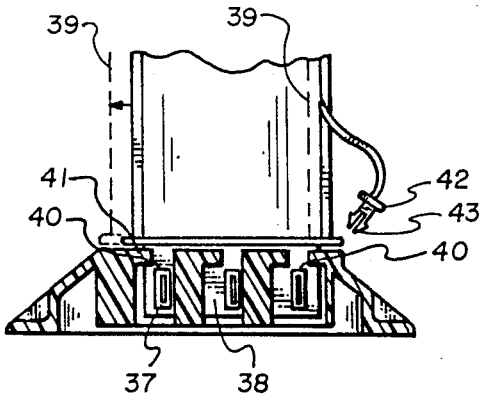
FIG. 3 shows a cross section of the permanent receiving base taken along the lines 3—3.

For example, in FIG. 1 a slide lock mechanism is illustrated for retaining the delineator member within the permanent base 30. The slide lock member comprises a tab section 35 which includes the slide lock members 37 projecting forward and rearward (not shown). The receiving base includes a slot configuration 34 which has a track channel 38 which is formed in size and configuration to receive the tab section 35 with its attached locking members 37. This represents an insert position as shown in FIG. 3 wherein the delineator member has been vertically inserted into the support body in slot 34. A second position is provided in the support body which is represented by phantom lines 39, showing a lateral position wherein the delineator is repositioned side ways with the locking members 37 being displaced below locking projections 37 which extend horizontally from the tab and have upper locking surfaces 40 which engage the underside of horizontal locking flanges 41. These locking flanges are integrally formed within the base member and provide engaging surfaces which prevent the delineator from being lifted upward and free from the slot 34. A retaining key 42 is coupled to the delineator and is configured for insertion into the slot left vacant as the delineator body is slid laterally into the lock position. This key 42 has a retaining base 43 which locks its position within the open slot section.

Figure 4:
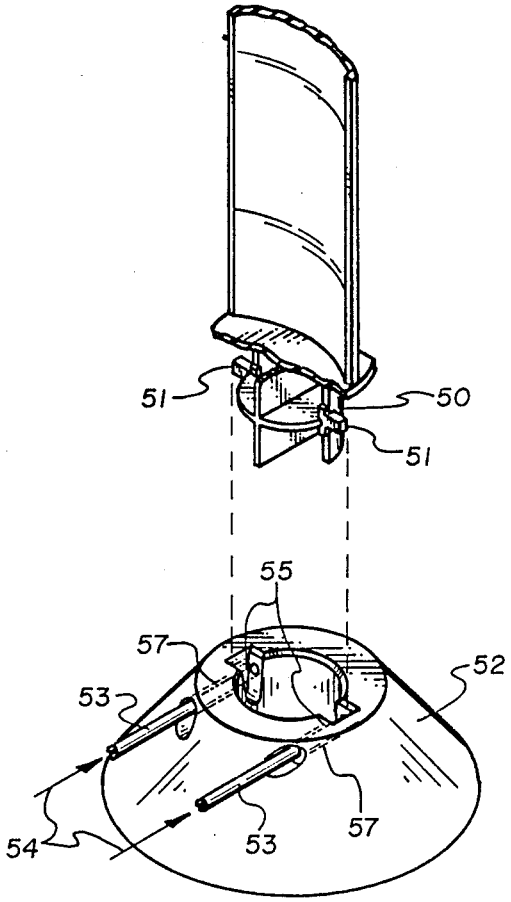
FIG. 4 shows a perspective view of an alternate embodiment of the present invention adapted with a different structure for inserting and locking the two members in fixed position.

FIG. 4 discloses an additional embodiment with a slidable pin locking system. In this instance, the tab section 50 comprises an arcuate channel with a base lift 51 extending across the lower end of the channel. This lip 51 operates as a looking flange which is retained in its inserted position within the base 52 by means of locking pins 53 which are inserted within the base as shown by arrows 54. Upon full insertion, these pins engage a top surface of the lip 51 as shown by the phantom lines 55. These pins thereby prevent the removal of the delineator body from the base 52. The respective pins 53 are journaled within pin chambers 57 which provide slidable tracks for their insertion or removal.

Typical dimensions for these devices comprise 15 inches in span for the horizontal member and approximately 6 inches in height. The total height from the base 10 to the top edge of the horizontal member is 18 inches. The vertical support member has approximately a four inch width. The receiving base is approximately 1¾ inches high with approximately six inch diameter across the bottom surface.

The receiving base may be constructed of ABS material for high strength and may be applied by the use of mastic adhesive pads which assist in adhesion of the base to a road surface or paving area. The delineator body is made of thermal plastic resin such as polyethylene.

The insertable delineator body is of one piece or integral construction, typically injection molded. The receiving base is likewise injection molded of durable material such as ABS. Because of this simple two piece structure, assembly and removal are very simple. The base is adhered to a paving surface, and the delineator body is inserted within the slot 34 and laterally or otherwise locked in position. This provides low maintenance cost and low risk to maintenance personnel who are otherwise exposed to local traffic.

It will be apparent to those skilled in the art that the foregoing description is meant to be exemplary and should not be limiting, except in accordance with the following claims.

I claim:

1. A delineator device having high visibility and utility for attachment to a paving surface, said device comprising a non-tubular, insertable delineator body of one piece construction including:

(a) a base member including a plate with upper and lower faces, said base member including a projecting tab section vertically coupled to the lower face of the base at one end and extending downward therefrom;

(b) a vertical support member having a top end and a bottom end and an intermediate section including an elongated concavo-convex structure configured to face toward on-coming traffic when mounted at the paving surface, said bottom end being integrally formed with the upper face of the base in vertical orientation;

(c) a horizontal member integrally formed with the top end of the vertical support member and having a top edge and a bottom edge, opposing distal sides and an interior section intermediate between the top and bottom edges and between the opposing distal sides and which includes an elongated concavo-convex structure configured to face toward on-coming traffic when mounted at the paving surface;

(d) a receiving base member adapted for direct attachment at the paving surface and having a top face and a substantially flat bottom face and an intermediate support body having a length sufficient to vertically support the length of the tab section and attached delineator device and including a slotted portion configured to receive the tab section therein with a snug fit;

(e) means for locking the tab section within the slotted portion to retain the device in position at the paving surface, said locking means comprising at least one horizontal slide-lock member projecting from the tab section of each side thereof, said support body including a horizontal slide-track channel formed in size and configuration to first receive the slide-lock members in a vertical insert position and to provide a second locking position which is lateral of the insert position top form a slide path and provide a tight fit for the slide-lock members.

2. A device as defined in claim 1, wherein the slide-lock member includes locking projections which extend horizontally from the tab and having upper locking surfaces, said support body including horizontal locking flanges which extend immediately above the locking surfaces when the slide-lock member is laterally displaced in the slide path into a locked position.

3. A delineator device having high visibility and utility for attachment to a paving surface, said device comprising:

(a) a base member including a plate with upper and lower faces, said base member including a projecting tab section vertically coupled to the lower face of the base at one end and extending downward therefrom;

(b) a vertical support member having a top end and a bottom end and an intermediate section including an elongated concavo-convex structure configured to face toward on-coming traffic when mounted at the paving surface, said bottom end being coupled to the upper face of the base in vertical orientation;

(c) a horizontal member centrally coupled near the top end of the vertical support member and having a top edge and a bottom edge, opposing distal sides and an interior section intermediate between the top and bottom edges and between the opposing distal sides and which includes an elongated concavo-convex structure configured to face toward on-coming traffic when mounted at the paving surface;

(d) a receiving base member adapted for direct attachment at the paving surface and having a top face and a substantially flat bottom face and an intermediate support body having a length sufficient to vertically support the length of the tab section and attached delineator device and including a slotted portion configured to receive the tab section therein with a snug fit;

(e) means for locking the tab section within the slotted portion to retain the device in position at the paving surface, said locking means comprising at least one horizontal slide-lock member projecting from the tab section of each side thereof, said support body including a horizontal slide-track channel formed in size and configuration to first receive the slide-lock members in a vertical insert position and to provide a second locking position which is lateral of the insert position to form a slide path and provide a tight fit for the slide-lock members.

4. A device as defined in claim 3, wherein the slide-lock member includes locking projections which extend horizontally from the tab and having upper locking surfaces, said support body including horizontal locking flanges which extend immediately above the locking surfaces when the slide-lock member is laterally displaced in the slide path into a locked position.

5. A delineator device and mounting base comprising:

(a) a base member including a plate with upper and lower faces said base member including a projecting tab section vertically coupled to the lower face of the base at one end and extending downward therefrom;

(b) a vertical support member having a top end and a bottom end and an intermediate section, including an elongated concavo-convex structure configured to face toward on-coming traffic when mounted at the paving surface, said bottom end being coupled to the upper face of the base member in vertical orientation;

(c) a horizontal member centrally the top end of the vertical support member and having a top edge and a bottom edge, opposing distal sides and an interior section intermediate between the top and bottom edges and between the opposing distal sides and which includes an elongated concavo-convex structure configured to face toward on-coming traffic when mounted at the paving surface;

(d) a receiving base member adapted to direct attachment at the paving surface and having a top face an d a substantially flat bottom face and an intermediate support body having a length sufficient to vertically support the length of the tab section and attached delineator device and including a slotted portion configured to receive the tab section therein with a snug fit;

(e) at least one horizontal slide-lock member projecting from the tab section at each side thereof, said support body including a horizontal slide-track channel formed in size and configuration to first receive the slide-lock members in a vertical insert position and to provide a second locking position which is lateral of the insert position to form a slide path and provide a tight fit for the slide-lock members.

* * * * *